US006299016B1

(12) United States Patent
Bando et al.

(10) Patent No.: US 6,299,016 B1
(45) Date of Patent: Oct. 9, 2001

(54) STACKED BODY OF WET SHEETS

(75) Inventors: Takeshi Bando; Yoshikazu Tanaka, both of Kagawa (JP)

(73) Assignee: Uni-Charm Corporation, Kawanoe (JP)

( * ) Notice: Subject to any disclaimer, the term of this patent is extended or adjusted under 35 U.S.C. 154(b) by 0 days.

(21) Appl. No.: 09/396,489

(22) Filed: Sep. 14, 1999

(30) Foreign Application Priority Data

Oct. 9, 1998 (JP) ..... 10-287678

(51) Int. Cl.[7] ..... B65H 1/00; A47K 10/24

(52) U.S. Cl. ..... 221/33; 221/33; 221/38; 221/45; 221/48; 206/207

(58) Field of Search ..... 221/33, 34, 38, 221/45, 48, 49, 55, 63; 206/207, 209, 210, 494, 499, 812

(56) References Cited

U.S. PATENT DOCUMENTS

| | | | | |
|---|---|---|---|---|
| 1,430,709 | | 10/1922 | Wheeler . | |
| 2,772,021 | * | 11/1956 | Kettles | 221/33 |
| 3,207,360 | | 9/1965 | Scott | 221/48 |
| 3,679,095 | * | 7/1972 | Nissen et al. | 221/50 X |
| 4,138,034 | * | 2/1979 | McCarthy | 221/33 X |
| 4,638,921 | * | 1/1987 | Sigl et al. | 221/48 X |
| 5,992,682 | * | 11/1999 | Loppnow et al. | 221/48 X |
| 6,109,430 | * | 8/2000 | Bando et al. | 206/207 X |

FOREIGN PATENT DOCUMENTS

| | | | |
|---|---|---|---|
| 0879 575A1 | 11/1998 | (EP) | A47K/10/42 |
| 0983 739A2 | 3/2000 | (EP) | A47K/10/42 |

* cited by examiner

*Primary Examiner*—Christopher P. Ellis
*Assistant Examiner*—Gene O. Crawford
(74) *Attorney, Agent, or Firm*—Darby & Darby

(57) ABSTRACT

A wet sheet stacked body to be housed in one of container and package, composed of a plurality of folded wet sheets. The folded wet sheets are consecutively combined such that a lower fold of an upper folded wet sheet is sandwiched by an upper fold of a succeeding lower wet sheet. A gap is formed between a folding line forming the lower folded portion of the upper wet sheet and a folding line forming the upper folded portion of the lower wet sheet.

3 Claims, 6 Drawing Sheets

STACKED BODY OF WET SHEETS

FIELD OF THE INVENTION

The present invention relates to a stacked body of folded wet sheets to be housed in a container or package.

BACKGROUND OF THE INVENTION

In general, wet sheets, such as wet tissues, wet towels or the like, are sealed and housed in a container or package so as to keep their wet state before use or when unused. These wet sheets are folded and stacked, such that they have overlapping portions between the upper and lower wet sheets, so that they are consecutively and sequentially pulled out of an outlet provided in the container or package. When the upper wet sheet confronting the outlet is pulled out, an upper folded portion of the next succeeding lower wet sheet is protruded from the outlet.

Here, because the wet sheets are combined while being impregnated with liquid, the sheets are in face-to-face contact with each other while having the liquid intervened therebetween, so that the surface tension by the liquid between the sheets exhibits a high adhesion (or engaging force). Therefore, when the upper wet sheet is pulled out, although only the upper folded portion of the next succeeding wet sheet is expected to protrude, such a problem may arise that the not only the upper folded portion but also the remaining portion of the next succeeding wet sheet is adhered to the upper wet sheet and pulled out of the outlet together with the upper wet sheet. As a result, the length of the protrusion of the next succeeding wet sheet becomes excessive.

If the protrusion of the wet sheet is too large, it can not be confined within the area of a cover which is usually provided with the container or package to cover the outlet. As a result, the protrusion partially extends out of the cover. Then, the wet sheet dries up at this portion extending out of the cover. Moreover, when the protrusion partially extends out of the cover, it is difficult to close the cover reliably. This lowers the sealability of the container or package, so that the overall wet sheet stacked body is liable to dry up.

SUMMARY OF THE INVENTION

The invention has been conceived to solve the above-mentioned problems of the prior art and has an object to provide a wet sheet stacked body in which when an upper wet sheet is pulled out, the length of the protrusion of a next succeeding lower wet sheet is reliably adjusted.

The present invention provides a wet sheet stacked body to be housed in one of a container and package, comprising a plurality of folded wet sheets, wherein the folded wet sheets are consecutively combined such that a lower fold of an upper folded wet sheet is sandwiched by an upper fold of a succeeding lower wet sheet, wherein a gap is formed between a folding line forming the lower fold of the upper wet sheet and a folding line forming the upper fold of the lower wet sheet.

Preferably, the gap is about 3 to 8 mm.

DETAILED DESCRIPTION OF THE INVENTION

The invention will be described with reference to the accompanying drawings.

Figure 1A:
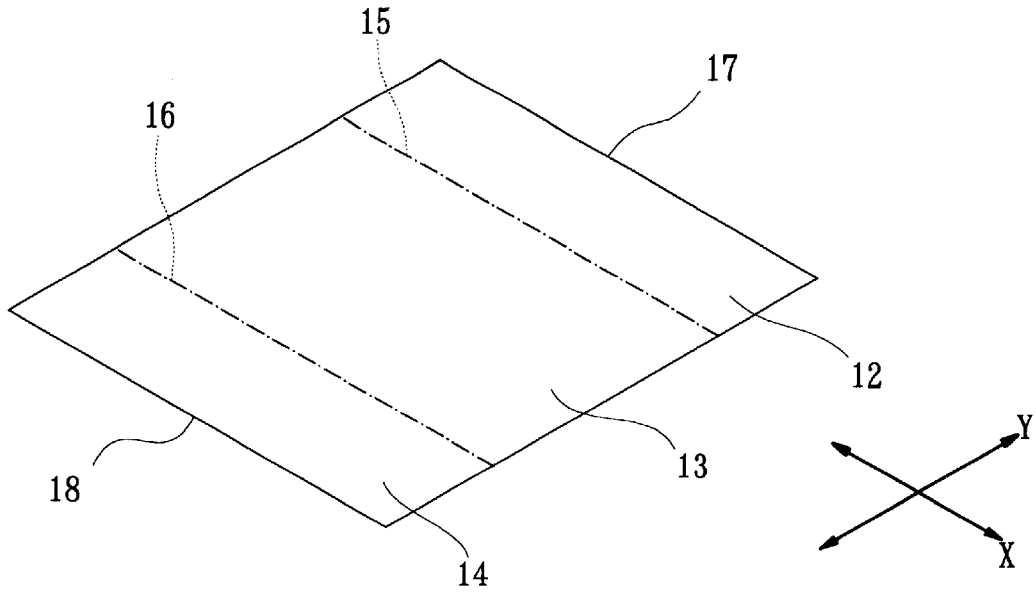
FIGS. 1(A) and 1(B) are perspective views showing a method of folding a wet sheet for an embodiment of the wet sheet stacked body according to the invention.
Figure 1B:
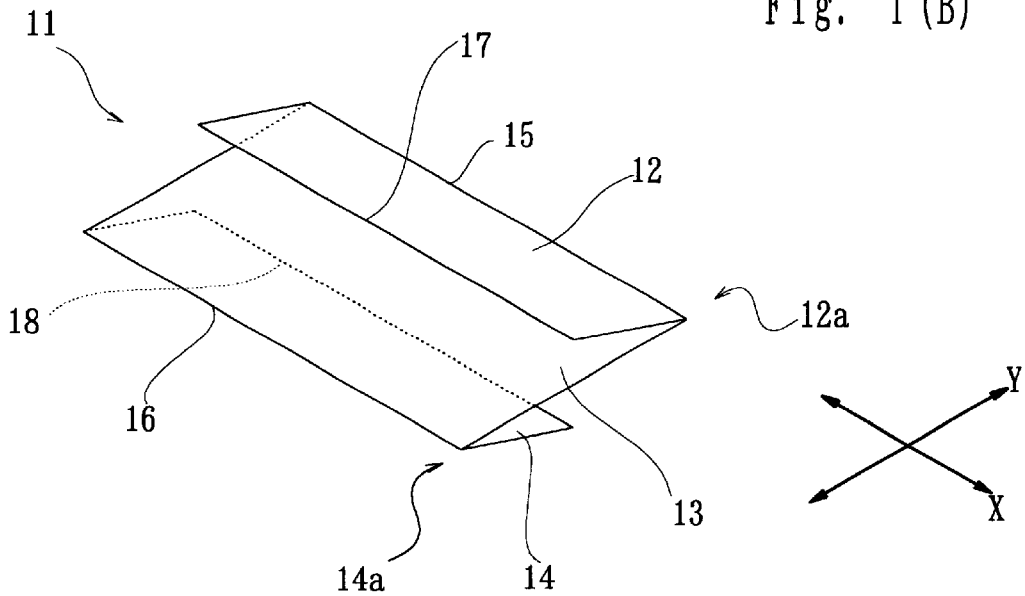
Figure 2:
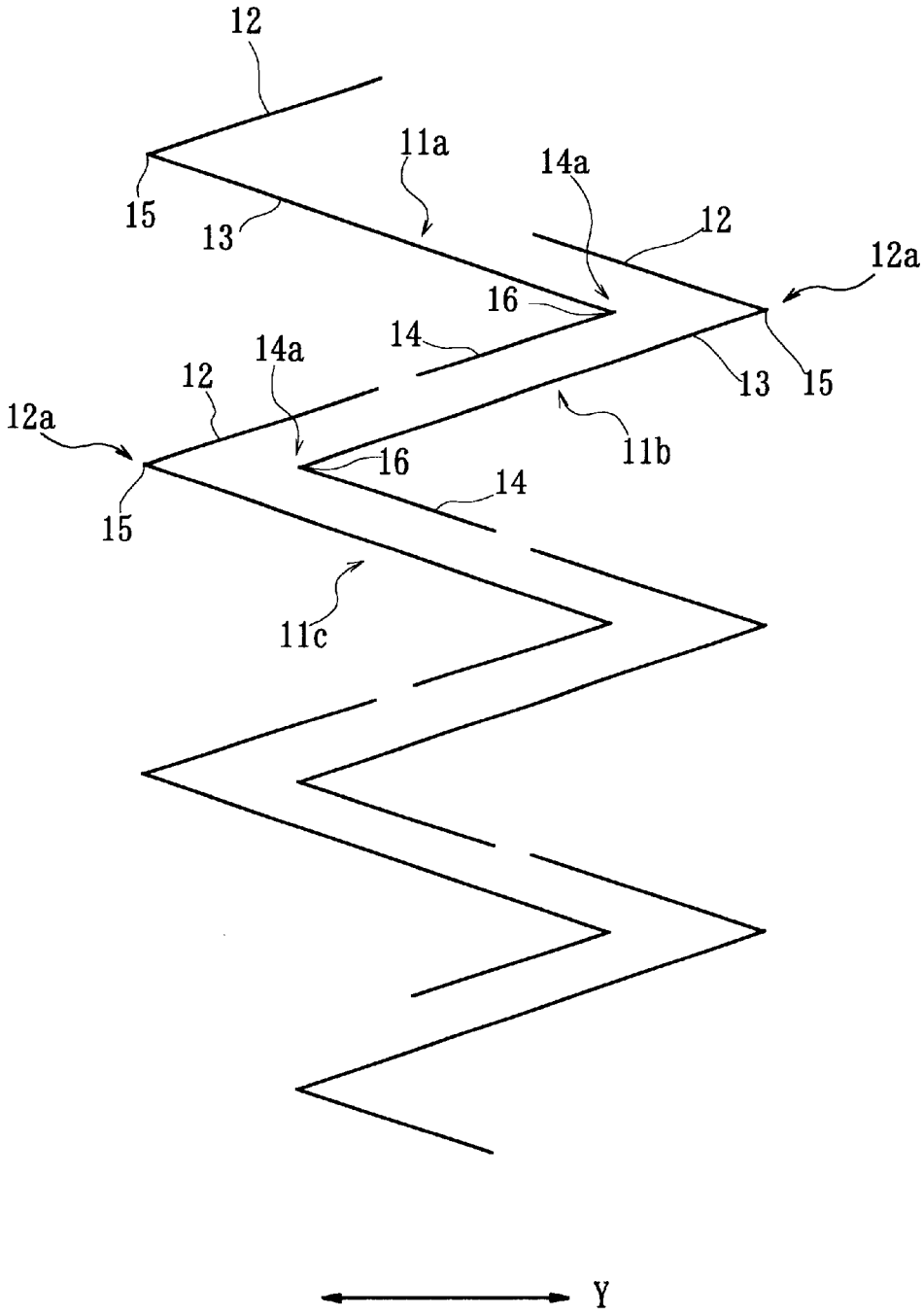
FIG. 2 is a section for explaining a method of combining the folded wet sheets shown in FIG. 1(B)
Figure 3:
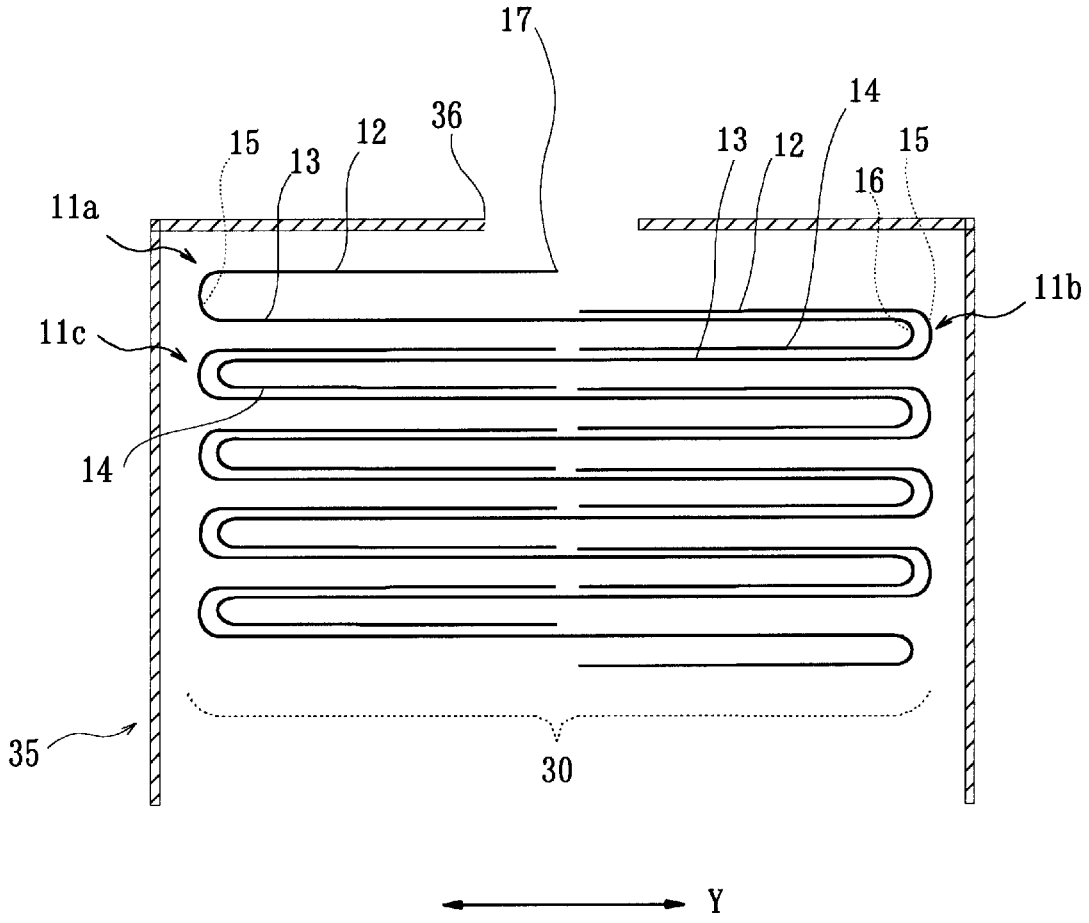
FIG. 3 is a section of a wet sheet stacked body which is housed in a container.
Figure 4:
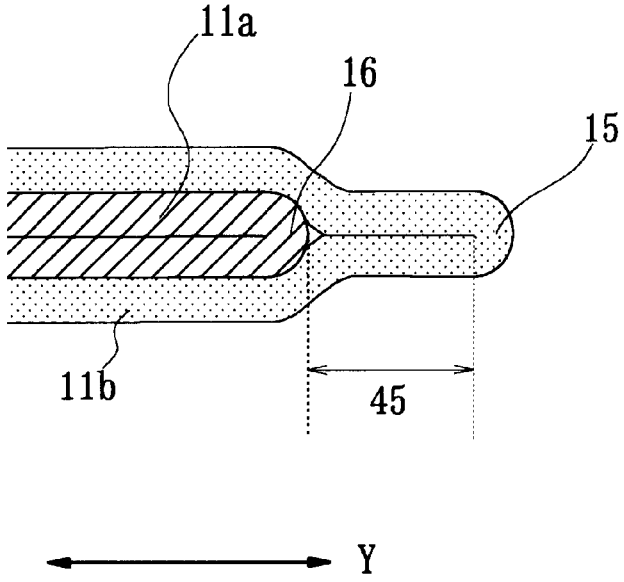
FIG. 4 is a partially enlarged section showing a portion including folding lines of upper and lower wet sheets.
Figure 5:
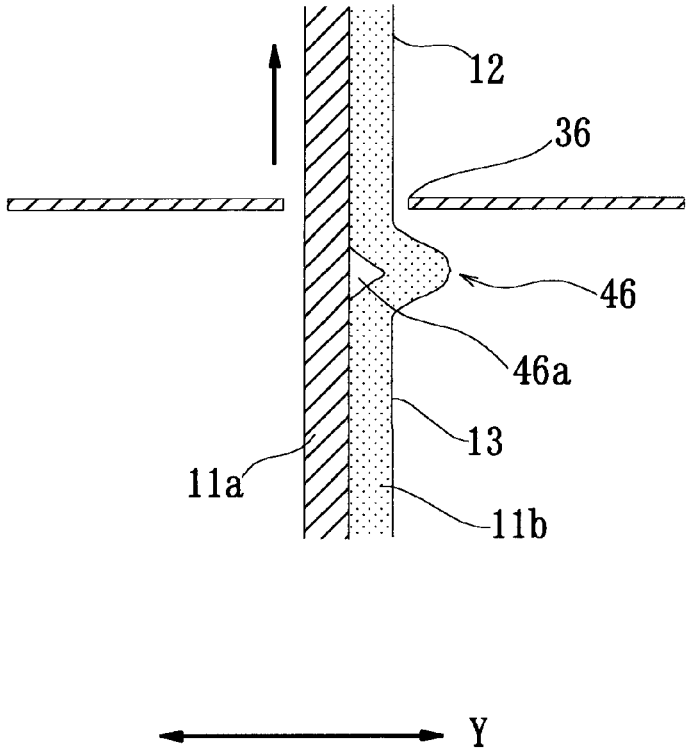
FIG. 5 is an explanatory diagram of a process for pulling out the wet sheet shown in FIG. 4.

FIGS. 1(A) and 1(B) are perspective views showing a method of folding a plane wet sheet to form a folded wet sheet for a wet sheet stacked body of the invention. FIG. 2 is a section for explaining a method of combining the folded wet sheets shown in FIG. 1(B). FIG. 3 is a section showing the wet sheet stacked body which is housed in a container. FIG. 4 is a partially enlarged section showing a portion including folding lines of upper and lower wet sheets. FIG. 5 is an explanatory diagram of a process for pulling out the wet sheet.

Here will be described a folded wet sheet 11 to compose the wet sheet stacked body of the invention. The folded wet sheet 11 is formed by folding a plane wet sheet into a general shape of letter "Z", as shown in FIG. 1(B). As shown in FIG. 1(A), the plane wet sheet before being folded has a rectangular shape (having a lateral dimension in the direction X and a longitudinal dimension in the direction Y). The folded wet sheet 11 has an upper fold 12*a* and a lower fold 14*a*. The upper fold 12*a* is formed by folding one laterally extending edge 17 upward along a folding line 15, whereas the lower fold 14*a* is formed by folding the other laterally extending edge 18 downward along a folding line 16. Here, a portion between the folding line 15 and the folding line 16 is designated an intermediate portion 13, a portion between the folding line 15 and the edge 17 is designated an upper folded portion 12, and a portion between the folding line 16 and the edge 18 is designated a lower folded portion 14. That is, the upper fold 12*a* is formed by the upper folded portion 12 and the intermediate portion 13, whereas the lower fold 14*a* is formed by the lower folded portion 14 and the intermediate portion 13. Here, in this embodiment (as shown in FIGS. 1(A) and 1(B)), the folding lines 15 and 16 extend in the direction X (i.e., in the lateral direction of the unfolded wet sheet), and the folding line 15 is spaced from the edge 17 by about one quarter of the longitudinal dimension of the plane wet sheet (i.e., unfolded wet sheet) whereas the folding line 16 is spaced from the edge 18 by about one quarter of the longitudinal dimension of the plane wet sheet (i.e., unfolded wet sheet). Therefore, the upper folded portion 12 and the lower folded portion 14 each have an area of about one quarter as large as that of the plane wet sheet (i.e., unfolded wet sheet).

The folded wet sheets 11 thus obtained are stacked in such a manner as shown in FIG. 2, such that a wet sheet stacked body 30 as shown in FIG. 3 is provided. Here, in order to facilitate the explanation of the stacked state, the individual folded wet sheets 11 are designated numerals 11*a*, 11*b* and 11*c* in an order which begins from the top of the stacked body 30. The lower fold 14*a* of the wet sheet 11*a* is sandwiched by the upper fold 12*a* of the wet sheet 11*b*. That is, the folding line 16 forming the lower fold 14*a* of the wet sheet 11*a* is sandwiched between the upper folded portion 12 and the intermediate portion 13 of the wet sheet 11*b*. Then, the lower fold 14*a* of the wet sheet 11*b* is sandwiched by the upper fold 12*a* of the wet sheet 11*c*.

As described above, a plurality of the folded wet sheets 11 are consecutively combined to provide the wet sheet stacked body 30, as shown in FIG. 3. This stacked body 30 is constructed by combining a number of, e.g., fifty or one hundred wet sheets, and then housed in a container 35 in which an outlet 36 for pulling out the wet sheets is formed on its upper side.

FIG. 4 is a partially enlarged section showing a portion including the folding line 16 of the wet sheet 11*a* and the folding line 15 of the wet sheet 11*b*. In FIG. 4, a gap (or distance) 45 is left between the folding line 16 of the wet sheet 11*a* and the folding line 15 of the wet sheet 11*b*. As exemplified in the relation between the wet sheet 11*a* and the wet sheet 11*b*, the wet sheet stacked body 30 is formed such that a predetermined gap (or distance) 45 is set between the folding line 15 of the lower wet sheet and the folding line 16 of the upper wet sheet. In other words, the stacked body is formed such that the folding line 15 of the lower wet sheet is separated appropriately to the outside in the direction Y from the folding line 16 of the upper wet sheet.

FIG. 5 shows the state in which the wet sheet 11*a* shown in FIG. 4 is pulled out from the outlet 36. In the wet sheet stacked body 30, because the upper and lower wet sheets are in face-to-face contact relation having liquid intervened therebetween, so that they are adhered to each other by the surface tension of the intervening liquid. In this case, when the wet sheet 11*a* is pulled out from the outlet, a bulge 46 is formed between the upper folded portion 12 and the intermediate portion 13 of the succeeding wet sheet 11*b*, as shown in FIG. 5. More specifically, the bulge 46 is formed such that the wet sheet 11*b* is slackened by the gap 45 when the intermediate portion 13 and the lower folded portion 14 of the wet sheet 11*a* are unfolded in a general plane.

A cavity 46*a* is easily formed on the inner side of the bulge 46. With this cavity 46*a*, the close contact in the wet state between the upper and lower wet sheets can be easily broken because the air is admitted between the upper and lower wet sheets from the cavity 46*a*. Thus, when the wet sheet 11*a* is pulled out, the wet sheet 11*b* can be easily separated.

Further, if the opening width of the outlet 36 is set sufficiently narrow, the wet sheet 11*b*, which is pulled up in close contact with the wet sheet 11*a*, is easily subjected at its bulge 46 to a high resistance of the outlet 36. As a result, the wet sheet 11*b* is subjected to the resistance of the outlet 36 the instant that the upper folded portion 12 comes out of the outlet 36, so that the wet sheet 11*b* is separated from the wet sheet 11*a* and protrudes from the outlet 36 only at the upper folded portion 12.

As described above, in the stacked body 30 of the invention, when the upper wet sheet is pulled out, the next succeeding lower wet sheet allows its upper folded portion 12 to protrude from the outlet 36 while leaving its remaining intermediate portion 13 and lower folded portion 14 in the container 35. This prevents the lower wet sheet from being taken out together with the upper wet sheet. Moreover, because the lower wet sheet is prevented from protruding too long and the length of the protrusion is stabilized, it is relatively difficult for the wet sheet protruding from the outlet 36 to dry up, as compared with the prior art which has considerable variations in the length of the protrusion. Furthermore, this provides a good appearance. In the case where the container 35 is provided with a cover for closing the outlet 36, in addition, the protruding wet sheet from the outlet 36 can be easily confined within the area of the cover, so that the opening 36 is reliably closed with the cover.

In order to adjust the length of the protrusion of the next succeeding lower wet sheet without fail, the gap 45 between the folding line 15 of the lower wet sheet and the folding line 16 of the upper wet sheet is preferably about 3 to 8 mm, more preferably about 5 mm.

Incidentally, the outlet 36 is preferred to exhibit the function to apply the resistance to the bulge 46. For example, the opening width of the outlet 36 is preferably made smaller than the size in the direction Y of the folded wet sheet 11. In short, the outlet 36 is preferably given a function as the so-called "resisting portion" to apply the resistance to the bulge 46 and to prevent the succeeding wet sheet from being dragged and protruded more than necessary from the outlet 36 by the upper wet sheet.

Figure 6:
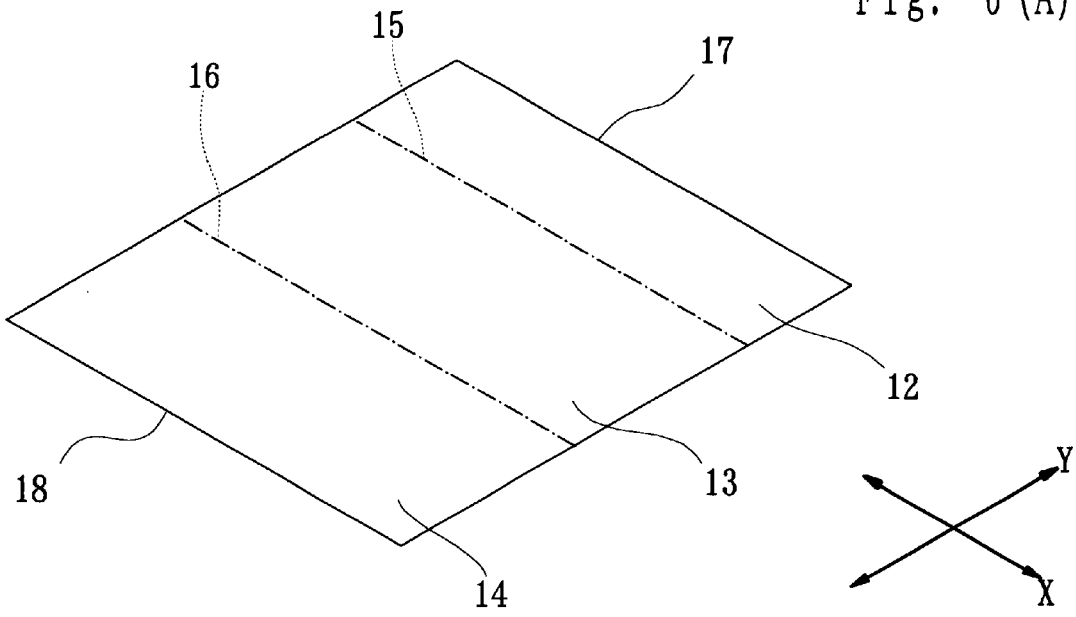
FIGS. 6(A) and 6(B) are perspective views showing a method of folding a wet sheet for another embodiment of the wet sheet stacked body according to the invention.
Figure 6:
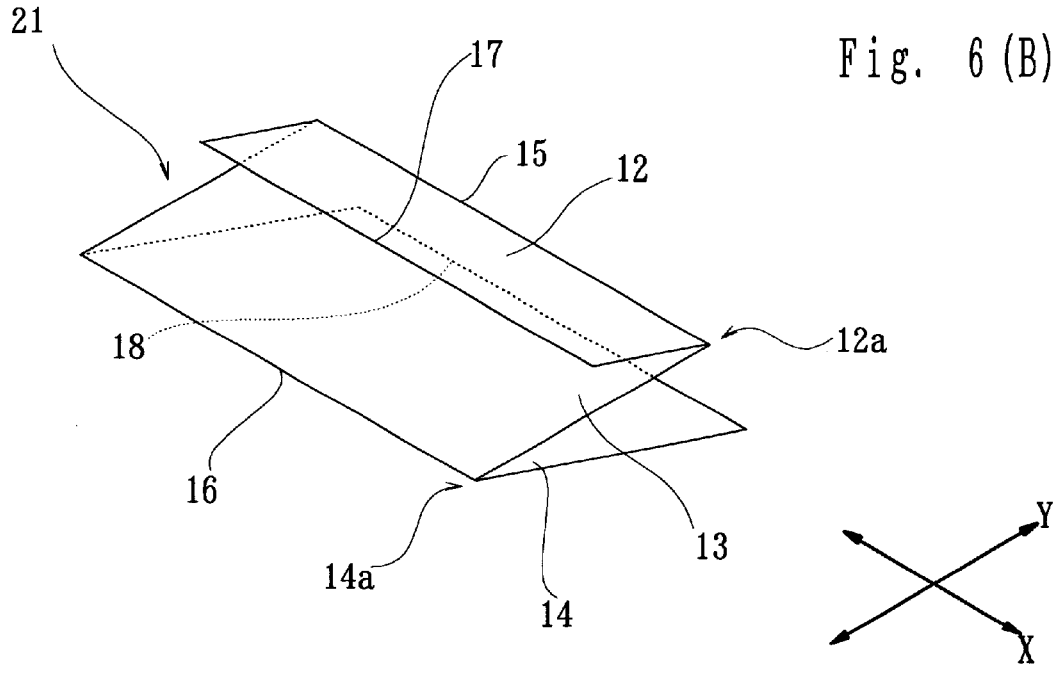
Figure 7:
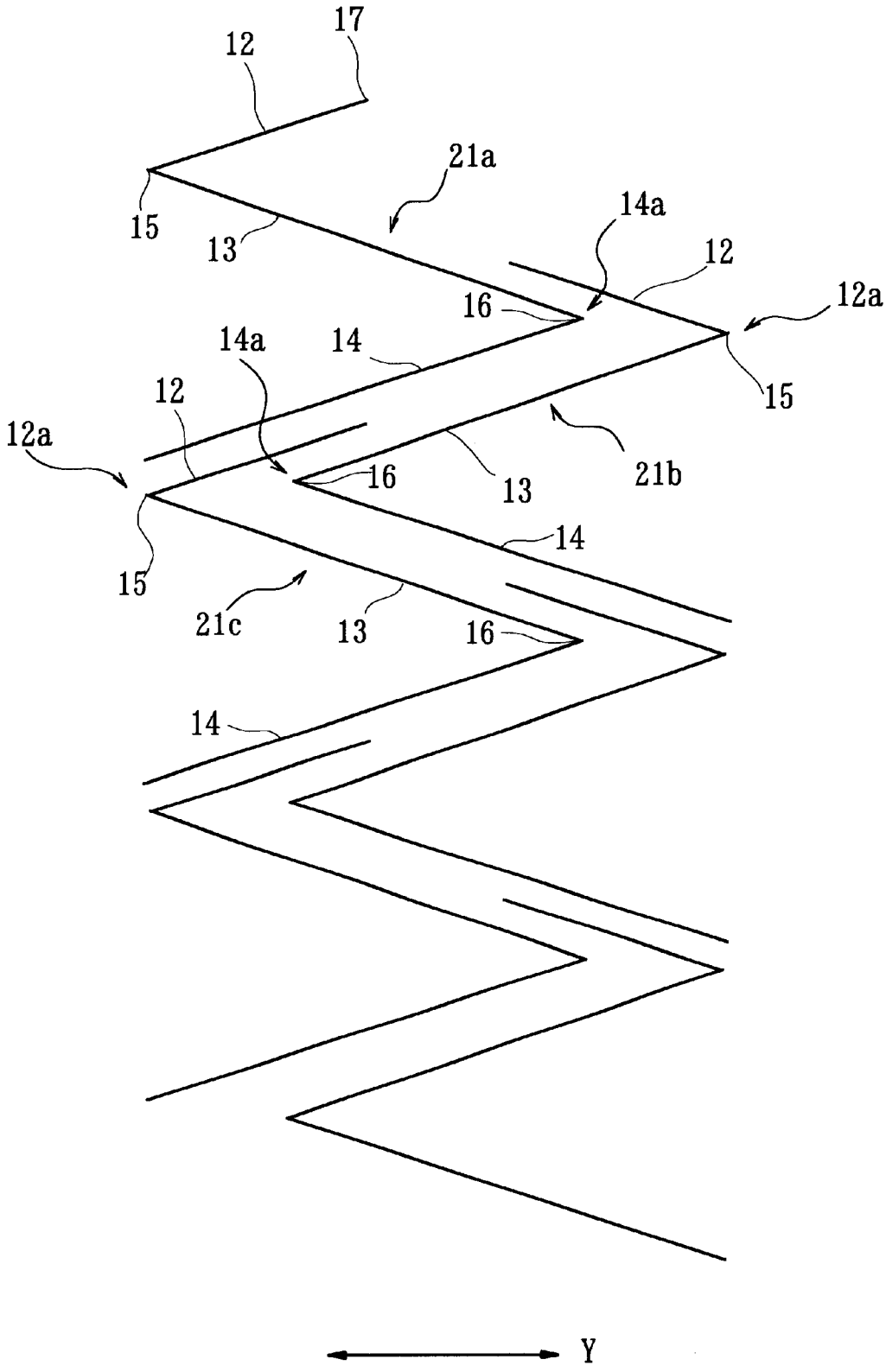
FIG. 7 is a section for explaining a method of combining the folded wet sheets shown in FIG. 6(B)

FIGS. 6(A) and 6(B) are perspective views showing a method of folding a wet sheet for another embodiment of the invention. FIG. 7 is a section for explaining a method of combining the folded wet sheets shown in FIG. 6(B). Hereinafter, the same components as those of the first embodiment will be described by the common reference numerals.

FIG. 6(A) shows the same rectangular plane wet sheet as that shown in FIG. 1(A). A folded wet sheet 21 is obtained by folding back the edges 17 and 18 along the folding lines 15 and 16 to the opposite sides to from the upper fold 12*a* and the lower fold 14*a*. In the second embodiment, however, the folding line 15 is spaced from the edge 17 by about one fifth of the longitudinal dimension of the unfolded wet sheet, but the folding line 16 is spaced from the edge 18 by about two fifths of the longitudinal dimension of the unfolded wet sheet. Therefore, the areas of the upper folded portion 12 and the lower folded portion 14 are about one fifth and about two fifths, respectively, of that of the unfolded wet sheet shown in FIG. 6(A). The folded wet sheet 21 thus obtained takes a shape of deformed letter "Z", as shown in FIG. 6(B).

The folded wet sheets 21 thus obtained are stacked in such a manner as shown in FIG. 7. Here, in order to facilitate the explanation of the stacked state, the individual folded wet sheets 21 are designated numerals 21*a*, 21*b* and 21*c* in an order which begins from the top. The lower fold 14*a* of the wet sheet 21*a* is sandwiched by the upper fold 12*a* of the wet sheet 21*b*. That is, the folding line 16 forming the lower fold 14*a* of the wet sheet 21*a* is sandwiched between the upper folded portion 12 and the intermediate portion 13 of the wet sheet 21*b*. Then, the lower fold 14*a* of the wet sheet 21*b* is sandwiched by the upper fold 12*a* of the wet sheet 21*c*. Here, in each of the folded wet sheet 21, the overall lower folded portion 14 necessarily comes into face-to-face contact with the intermediate portion 13. Moreover, the gap (or distance) 45, as shown in FIG. 4, is left between the folding line 16 of the upper wet sheet and the folding line 15 of the lower wet sheet. As described above, a plurality of the folded wet sheets 21 are consecutively stacked to provide the wet sheet stacked body.

In such a construction, when the wet sheet 21*a* is pulled out of the outlet by pinching its edge 17, the bulge 46 is formed along the folding line 15 of the lower wet sheet 21*b*, as in the stacked body 30 shown in FIG. 3. Then, the cavity 46*a* is formed on the inner side of the bulge 46, whereby the wet sheet 21*a* and 21*b* are easily separated from each other. Thus, when the wet sheet 21*a* is pulled out, the wet sheet

21*b,* which is in close contact with and pulled up together with the wet sheet 21*a,* is easily separated from the wet sheet 21*a,* at the bulge 46. Moreover, the wet sheet 21*b* is easily subjected to the high resistance of the outlet 36, at the bulge 46. As a result, the wet sheet 21*b* is separated from the wet sheet 21*a* the instant that the upper folded portion 12 comes out of the outlet 36, so that only the wet sheet 21*a* is pulled out of the outlet 36.

Incidentally, in the wet sheet stacked body obtained by the combination shown in FIG. 7, the length of the protrusion can be made shorter to about one fifth of the longitudinal dimension of the unfolded wet sheet.

The aforementioned wet sheets 11 and 21 are made of a nonwoven fabric or paper composed of natural fibers and/or synthetic fibers. For example, use can be made of a spun lace nonwoven fabric made of polyethylene or polypropylene and having a high wet strength. The size of the unfolded wet sheet can be suitably changed depending upon the intended purpose or the size of the container or package. In the case where a wet tissue is used as the wet sheet, its unfolded size is exemplified by about 150×200 mm. The wet sheets 11 and 21 are impregnated with water, alcohol, humectants, surface active agents, perfumes, antiseptics, mildewcides or the like.

The container 35 is made from a relatively hard synthetic resin such as polyethylene, polypropylene or the like. The outlet 36 is preferably provided with a cover for closing (covering around) the outlet 36 so as to seal up the container 35 and prevent the protruded wet sheet from drying up. Alternatively, instead of the hard container 35, a package (or envelope) of a liquid-impermeable film may be used to house the wet sheet stacked body. In addition, the wet sheet stacked body of the invention can also be used as the so-called "refill package", in which the wet sheet stacked body housed in the package is further housed in a hard container, or the wet sheet stacked body housed in the package is taken out of the package and then put into the hard container. Examples of the hard container include a portable box, in which wet sheets for cleaning the baby's buttock or the like are contained, and a box to be fixed to a wall, desk or the like, in which wet sheets for use in the toilet, kitchen or the like are contained.

In the wet sheet stacked body of the invention, moreover, the length of the protrusion can be adjusted in accord with demand by adjusting the locations of the folding lines 15 and 16. Therefore, the folding lines 15 and 16 should not be limited to one quarter or one fifth, but may be located at one third or one sixth of the longitudinal dimension of the unfolded wet sheet from the edges, for example. Moreover, the present invention should not limited to those embodiments in which each wet sheet is folded into three portions, but can also be applied to a wet sheet stacked body in which each wet sheet is folded in a different way, for example, into four portions or five portions.

While in the foregoing specification this invention has been described in relation to preferred embodiments and many details have been set forth for purpose of illustration it will be apparent to those skilled in the art that the invention is susceptible to additional embodiments and that certain of the details described herein can be varied considerably without departing from the basic principles of the invention.

Further, 'comprises/comprising' when used in this specification is taken to specify the presence of stated features, integers, steps or components but does not preclude the presence or addition of one or more other features, integers, steps, components or groups thereof.

What is claimed is:

1. A wet sheet stacked body to be housed in one ot a container and package comprising:

a plurality of folded wet sheets, each formed by folding a plane wet sheet to have three portions comprising an intermediate portion; an upper folded plane portion including an opposite edge of the plane wet sheet and positioned above the intermediate portion; and a lower folded plane portion including another opposite edge of the plane wet sheet and positioned below the intermediate portion, wherein the folded wet sheets are consecutively combined such that an overlap of the lower folded plane portion and the intermediate portion of an upper folded wet sheet is sandwiched between the upper folded plane portion and the intermediate portion of a succeeding lower folded wet sheet, wherein between a folding line between the lower folded plane portion and the intermediate portion of the upper folded wet sheet and a folding line between the upper folded plane portion and the intermediate portion of the succeeding lower folded wet sheet, a gap is formed for permitting air to enter between the upper folded wet sheet and the succeeding lower folded wet sheet when the upper sheet is removed from one of the container and package, and wherein one of the container and package is formed with an outlet from which the upper wet sheet is pulled out while the lower wet sheet is applied with a resistance at a bulge formed between the upper folded plane portion and the intermediate portion.

2. The wet sheet stacked body according to claim 1, wherein:

the gap is about 3 to 8 mm.

3. The wet sheet stacked body according to claim 1, wherein:

the intermediate portion is planar.

* * * * *

UNITED STATES PATENT AND TRADEMARK OFFICE

CERTIFICATE OF CORRECTION

PATENT NO. : 6,299,016 B1 
DATED : October 9, 2001
INVENTOR(S) : Takeshi Bando and Yoshikazu Tanaka It is certified that error appears in the above-identified patent and that said Letters Patent is hereby corrected as shown below:

Title page,
Item [73], Assignee, change "Kawanoe (JP)" to -- Ehime (JP) --.

Signed and Sealed this

Thirteenth Day of August, 2002

*Attest:*

*Attesting Officer*

JAMES E. ROGAN
*Director of the United States Patent and Trademark Office*